US006494746B2

(12) United States Patent
D'Addario

(10) Patent No.: US 6,494,746 B2
(45) Date of Patent: Dec. 17, 2002

(54) ELECTRONIC SIGNAL PLUG CONNECTOR

(75) Inventor: James D'Addario, Old Westbury, NY (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 10/000,392

(22) Filed: Nov. 30, 2001

(65) Prior Publication Data

US 2002/0037669 A1 Mar. 28, 2002

Related U.S. Application Data

(63) Continuation of application No. 09/478,872, filed on Jan. 7, 2000.

(51) Int. Cl.[7] ..... H01R 17/18
(52) U.S. Cl. ..... 439/668
(58) Field of Search ..... 439/669, 668, 439/188, 825, 439

(56) References Cited

U.S. PATENT DOCUMENTS

| | | | | | |
|---|---|---|---|---|---|
| 2,610,223 | A | * | 9/1952 | Puerner | 439/669 |
| 3,893,743 | A | | 7/1975 | Wallo | 439/578 |
| 4,018,501 | A | * | 4/1977 | Maloof | 439/669 |
| 4,526,429 | A | | 7/1985 | Kirkman | 439/82 |
| 5,238,422 | A | * | 8/1993 | Scherer | 439/188 |
| 5,263,879 | A | * | 11/1993 | Sasa et al. | 439/668 |
| 5,419,707 | A | * | 5/1995 | Kelley | 439/21 |
| 5,508,621 | A | * | 4/1996 | Wong | 324/549 |
| 5,897,397 | A | * | 4/1999 | Yokozawa | 439/668 |
| 5,951,337 | A | * | 9/1999 | Brake | 439/825 |
| 6,193,559 | B1 | * | 2/2001 | Weingartner | 439/669 |

FOREIGN PATENT DOCUMENTS

| | | |
|---|---|---|
| DE | 42 40 556 | 6/1993 |
| EP | 0 923 170 | 6/1999 |

* cited by examiner

*Primary Examiner*—Neil Abrams
*Assistant Examiner*—Phuong K T Dinh
(74) *Attorney, Agent, or Firm*—Alix, Yale & Ristas, LLP

(57) ABSTRACT

A plug connector is provided for mating with a jack connector. The plug connector includes a base and a tubular member extending from the base. The tubular member includes a ground contact area adjacent the base, a conductive end distal to the base and an external, axially extending spring. The conductive end is insulated from the contact area and has a recess located thereon. This configuration permits retentively engaging the signal tip of the plug by corresponding structure in the jack, while simultaneously supporting the tubular portion of the plug with externally directed spring elements engaging corresponding structure in the jack, to achieve reduced relative movement when the plug connector and the jack connector are mated.

7 Claims, 8 Drawing Sheets

ELECTRONIC SIGNAL PLUG CONNECTOR

CROSS REFERENCE TO RELATED APPLICATION

The present application is a continuation claiming the benefit under 35 USC §120 of pending U.S. patent application Ser. No. 09/478,872, entitled "Electrical Plug Connectors", filed Jan. 7, 2000 and assigned to J. D'Addario & Company, Inc.

BACKGROUND OF THE INVENTION

1. Field of the Invention

The present invention relates generally to electrical plug connectors and, more particularly, relates to electrical plug connectors configured to provide reduced movement when connected to a jack and reduced likelihood of electrical discontinuity therebetween.

2. Description of Related Art

Plug and jack type connectors are well known for use in connecting, e.g., audio equipment. Typically, the plugs and jacks may connect a signal line and a ground (e.g., referred to as a monotype of connection) or two signal lines and a ground (e.g., referred to as a stereo type of connection). Generally, the jack includes a single wiper contact for each conductive portion of the plug. Because of, e.g., resiliency in the wipers and clearance, the plugs are somewhat moveable within the jack and through wear and the like the movement increases.

One typical use for a plug and jack connector is in the connection between a musical instrument and an amplifier. For example, electric guitars typically employ a jack, which receives a plug connected to one end of a cord. The other end of the cord may go directly to an amplifier or may connect to a radio transmitter linked to the amplifier. During playing of the guitar and movement thereof, a torque may be created on the plug connector by movement of the instrument causing movement of the plug within the jack resulting in intermittent electrical contact between the jack and plug. In turn, sound from the instrument may be intermittently output from the amplifier and/or "clicking" sounds may be generated by this intermittent contact.

SUMMARY OF THE INVENTION

Accordingly, it is an object of the present invention to provide a plug connector that achieves reduced relative movement when mated with a jack connector.

It is another object to provide the combination of a plug connector and jack connector that reduces the possibility of electrical discontinuity between the jack and the plug disposed therein while also assisting in reducing the relative movement therebetween.

In accordance with an embodiment of the present invention, a plug connector is provided for mating with a jack connector. The plug connector comprises a base and a tubular member extending from the base. The tubular member includes a ground contact area adjacent the base, a conductive terminal end distal to the base and insulated from the ground contact area, a circumferential groove located at the terminal end, and a spring portion bulging radially outward from the contact area and insulated from the terminal end.

In another aspect, the invention is directed to a plug connector on a cable having a ground conductor and at least one signal conductor, comprising a handle within which the cable is received, and a tubular member extending from the handle. The tubular member includes an electrically conductive, external ground contact area adjacent the handle and electrically connected to the ground conductor within the handle, and an insulative core extending within the ground contact area toward a distal end of the connector. The distal end has an electrically conductive external tip distal to the handle, electrically connected to a signal conductor by a wire extending within the core. Means are provided for insulating the external ground contact area from the tip. The tip has a recess formed thereon for retentively engaging a signal contact on the jack and the ground contact area is electrically connected with a plurality of axially extending, external spring elements for retentively engaging a ground contact on the jack.

In particular aspects of the present invention, the tubular member may further comprise an intermediate conductive portion disposed between and insulated from the ground contact area and the conductive terminal end. The spring preferably includes a plurality of strips bowed radially outward of and extending along the central axis of the tubular member.

The present invention provides a jack and plug connection which has reduced relative movement and thereby prevents, for example in an audio signal connection, intermittent and undesirable sounds.

BRIEF DESCRIPTION OF DRAWINGS

Other objects and advantages of the invention will be evident to one of ordinary skill in the art from the following detailed description made with reference to the accompanying drawings, in which.

DETAILED DESCRIPTION OF THE PREFERRED EMBODIMENT

Figure 1:
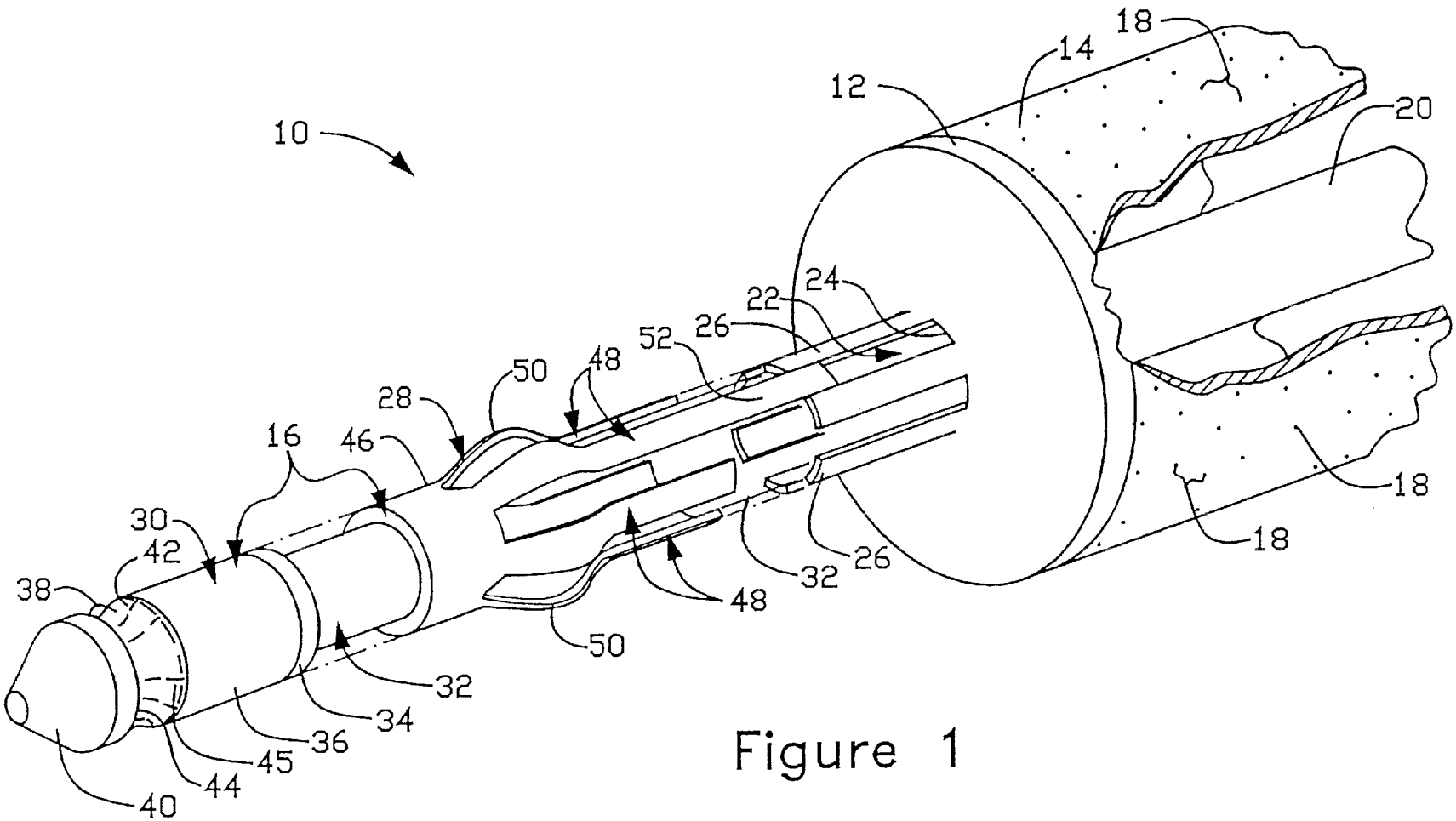
FIG. 1 is a partially exploded perspective view, partially broken away, illustrating a plug connector in accordance with an embodiment of the present invention.

A plug connector in accordance with one embodiment of the present invention is illustrated generally at 10. The plug connector 10 comprises a base 12 interposed between a handle portion 14 and a tubular member 16.

The handle portion 14 may be composed of any suitably rigid material, which may include friction-enhancing bumps 18 for an enhanced frictional grip.

A cable 20 is connected to the base 12 and may include a shielded single line (not shown) for conducting a signal as is well known.

The base 12 may be composed of an insulating material such as a molded thermoplastic, e.g., an acetyl resin, a nylon, an ABS resin and/or blends thereof and comprises a disk like shape and a central aperture 22 defined by a wall 24. Members 26 extend from the wall 24 and are circumferentially spaced thereabout and generally define a tubular shape.

The tubular member 16 comprises a spring portion 28 and a terminal end 30, both of which are disposed about a core member 32. The core member 32 comprises an insulating material such as a thermoplastic material as discussed above disposed about a conductor (not shown) and functions to electrically connect the terminal end 30 with the signal carrying portion of cable or wire 20 in a known manner.

The terminal end 30 may be composed of any suitably strong and durable material and is preferably a conductive material, e.g., a metallic substance such as copper, brass, steel plated with nickel, copper or gold for a low resistance, brass, beryllium copper, phosphor bronze or other material or alloy and is disposed adjacent an insulating ring 34 formed of, for example, a thermoplastic substance such as discussed above. The terminal end 30 comprises a cylindrical length 36, a groove 38 and a contact tip 40. The groove 38 is defined by a pair of shoulders 42 and 44, that may be separated by a curved portion 45.

In accordance with a feature of the present invention, the spring portion 28 functions to reduce movement of the plug connector 10 when disposed within a jack connector as discussed in more detail below. The spring portion 28 comprises a cylindrical contact area 46 and circumferentially spaced strips 48 extending therefrom along a central axis of the tubular member 16. The cylindrical contact area 46 and strips 48 may be composed of the same material as the terminal end 30 providing it is a suitably flexible and sufficiently strong material and is preferably spring tempered. Suitable materials include, for example, copper, steel plated with, e.g., nickel, copper or even gold for a low resistance, brass, beryllium copper, phosphor bronze or other materials or alloys. The strips 48 are bulged at 50 in order to provide a spring-like resiliency and are sufficiently spaced to fit between the members 26 of the base 12. The strips 48 flex when mated with a jack as discussed in more detail hereafter. One of the strips 48 includes a contact extension 52 for electrical contact with, e.g., the conductive shielding of wire 20 in a known manner.

Figure 2:
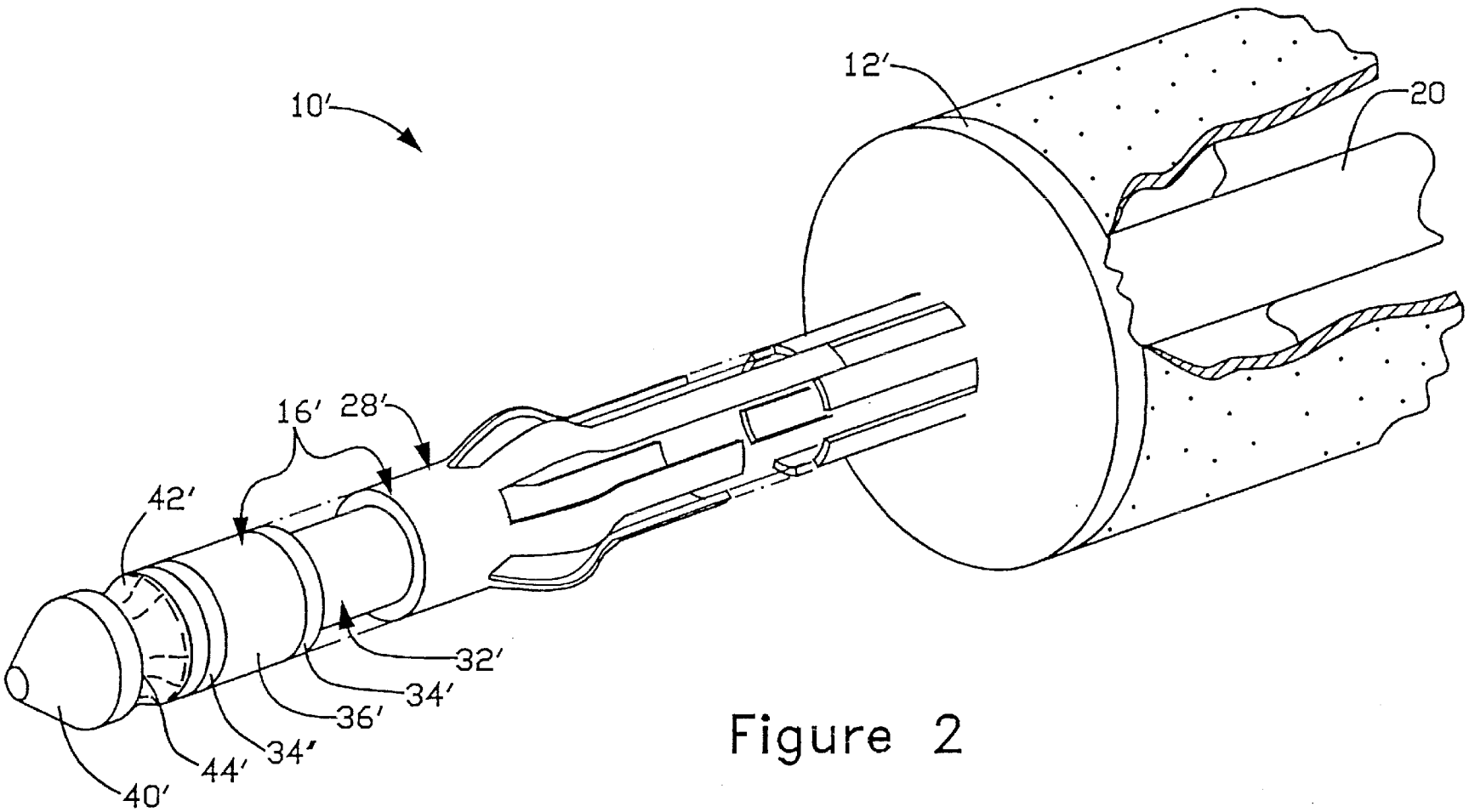
FIG. 2 is a partially exploded view of a plug connector in accordance with another embodiment of the present invention.

As illustrated in FIG. 2, another embodiment of a plug connector is illustrated at 10'. In this embodiment, the plug connector 10' comprises three electrical contacts, such as is used in a stereo audio connection. In this case, wire 20' carries two separately conductive lines (not shown) which are wrapped by a shield (not shown). The conductive lines may be electrically connected to a core member 32' that also comprises two conductive lines.

In order to provide an additional contact area, a pair of insulating rings 34' and 34" are provided and may be composed of the same material such as a thermoplastic material as the other insulating rings discussed above. The rings 34' and 34" insulate an additional cylindrical intermediate contact 36' that is separately conductive from spring portion 28' and shoulders 42', 44' and tip 40'. The cylindrical intermediate contact 36' is connected to one of the conductive lines of the core member 32' in a known manner.

Figure 4:
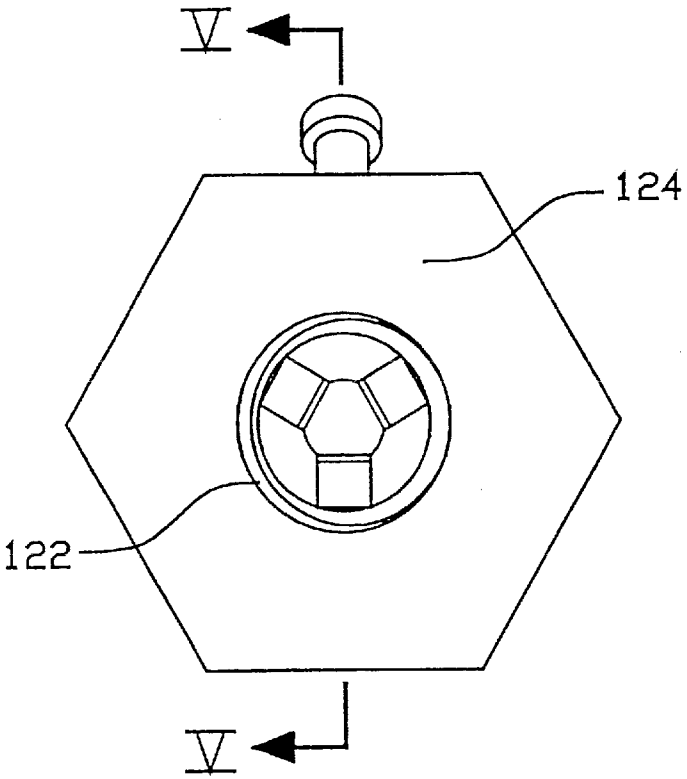
FIG. 4 is a side elevation view of the jack connector of FIG. 3.
Figure 3:
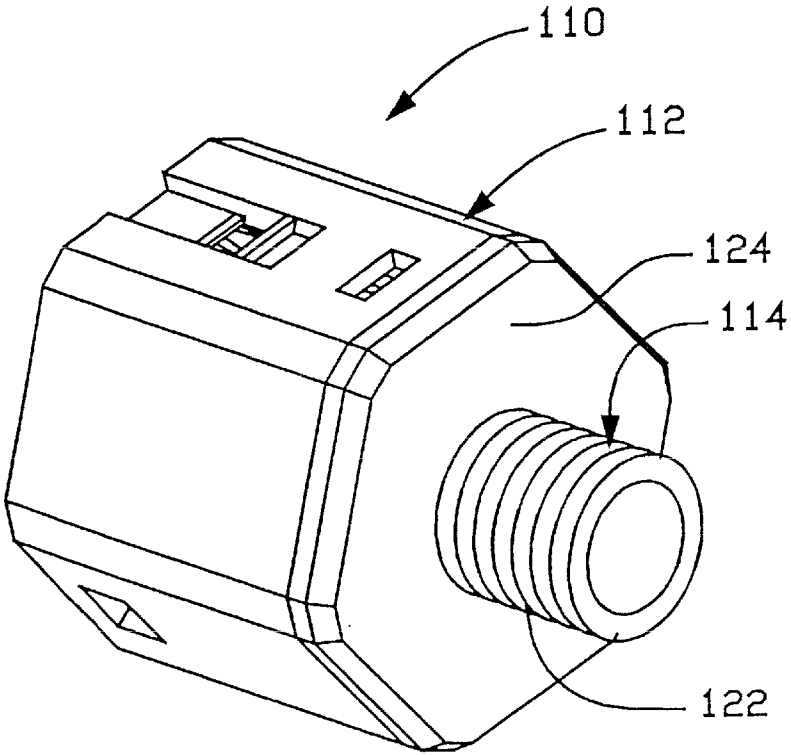
FIG. 3 is a perspective view of a jack connector, connectable with the plug connector of FIG. 1, in accordance with another embodiment of the present invention.
Figure 9:
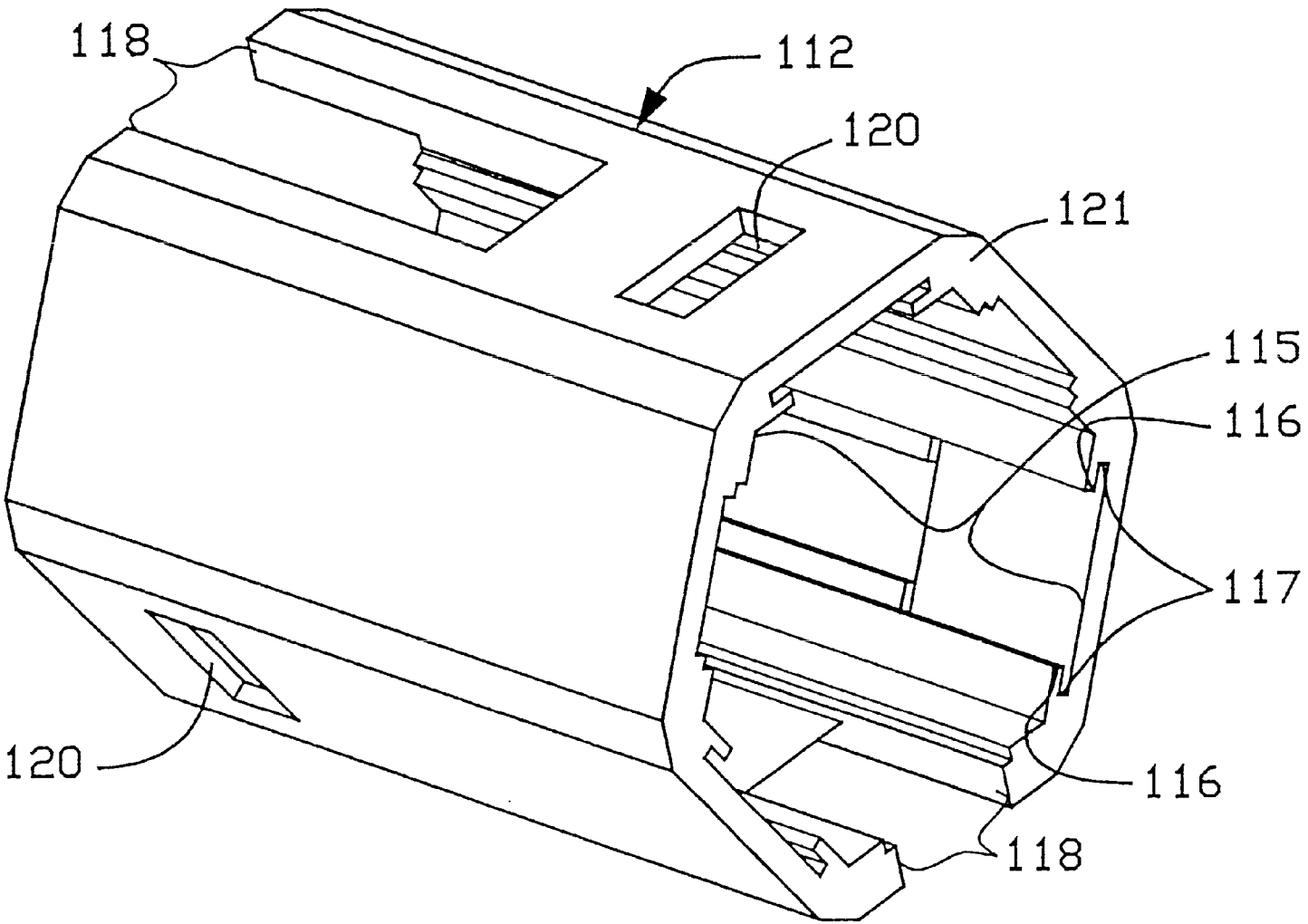
FIG. 9 is a perspective view of a portion of a jack housing in accordance with the embodiment of FIG. 3.

Referring now to FIGS. 3, 4 and 9, a jack connector is illustrated generally at 110. The jack connector 110 is preferably employed in combination with the plug connector 10 shown in FIG. 1 and discussed above, although, it will be understood that the jack connector may be employed with other compatible connectors and this is also the case for the plug connector.

The jack connector 110 comprises a body or housing 112 and a collar 114. The housing 112 may be composed of any suitably strong and durable insulating material such as a thermoplastic, for example, including any of those discussed above. The housing 112 comprises a generally tubular body including a central cavity 115, stepped portions 116 and channels or mounting slots 117 for receipt of electrical contacts as discussed in more detail below. The housing 112 also comprises through slots 118, window portions 120 and end 121.

The collar 114 may be composed of any suitably strong and durable metallic material, e.g., copper, steel plated with, e.g., nickel, copper or even gold for a low resistance, brass, beryllium copper, phosphor bronze or other material or alloy and is provided for engaging with, e.g., the strips 48 (FIG. 1) of the spring portion 28 of the plug connector 10. It will be appreciated that the collar 114 may also be composed of material such as a thermoplastic, e.g., any of those discussed above, although, wear may be enhanced where the corresponding plug employs a spring such as spring portion 28 (FIG. 1) discussed above. Preferably, the collar 114 is dimensioned to receive a spring such as spring portion 28 of the plug connector 10 to thereby provide a clamped fit between the plug connector and the jack connector 110 for reducing relative movement therebetween. The collar 114 comprises a threaded section 122 for mounting of the jack connector within, e.g., a musical instrument or amplifier (not shown) and a flange 124. The flange 124 is dimensioned to engage the end 121 of the housing 112 and, preferably, during manufacture the collar 114 may be insert molded with the housing. In such a case, extension tabs 125 of housing 112 may extend over the flange 124. The collar 114 may, in the case of a thermoplastic material, to be fixed to end 121 thereto by, for example, a suitable adhesive or ultrasonic welding. The diameter of the collar 122 is dimensioned to receive, for example, the spring portion 28 of the plug connector 10 (FIG. 1).

Figure 5:
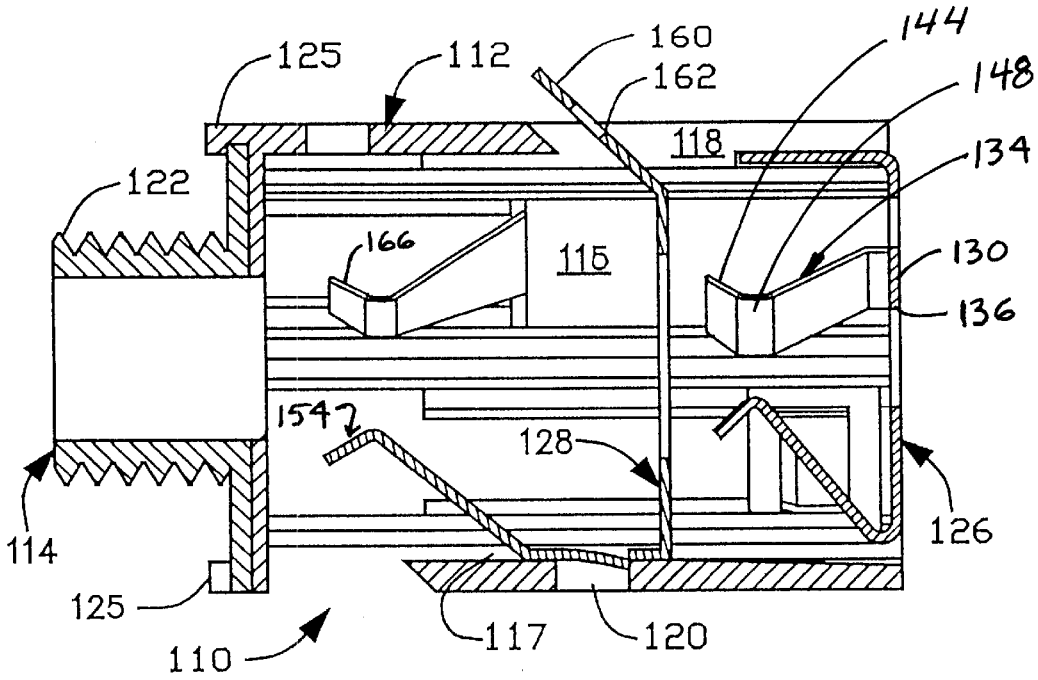
FIG. 5 is a sectional view taken along line V of FIG. 4.
Figure 7:
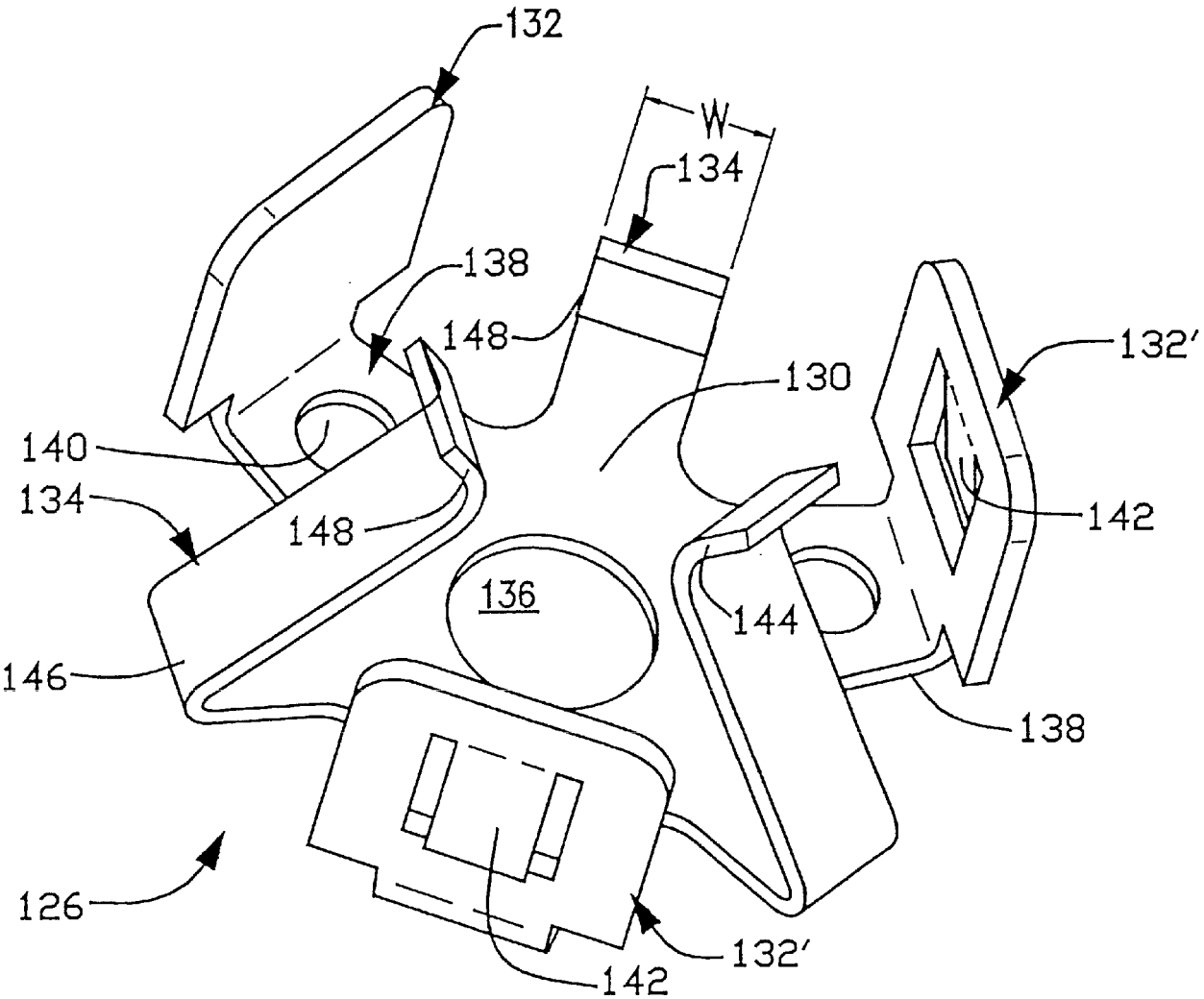
FIG. 7 is a perspective view of a contact element in accordance with the embodiment of FIG. 3.
Figure 8:
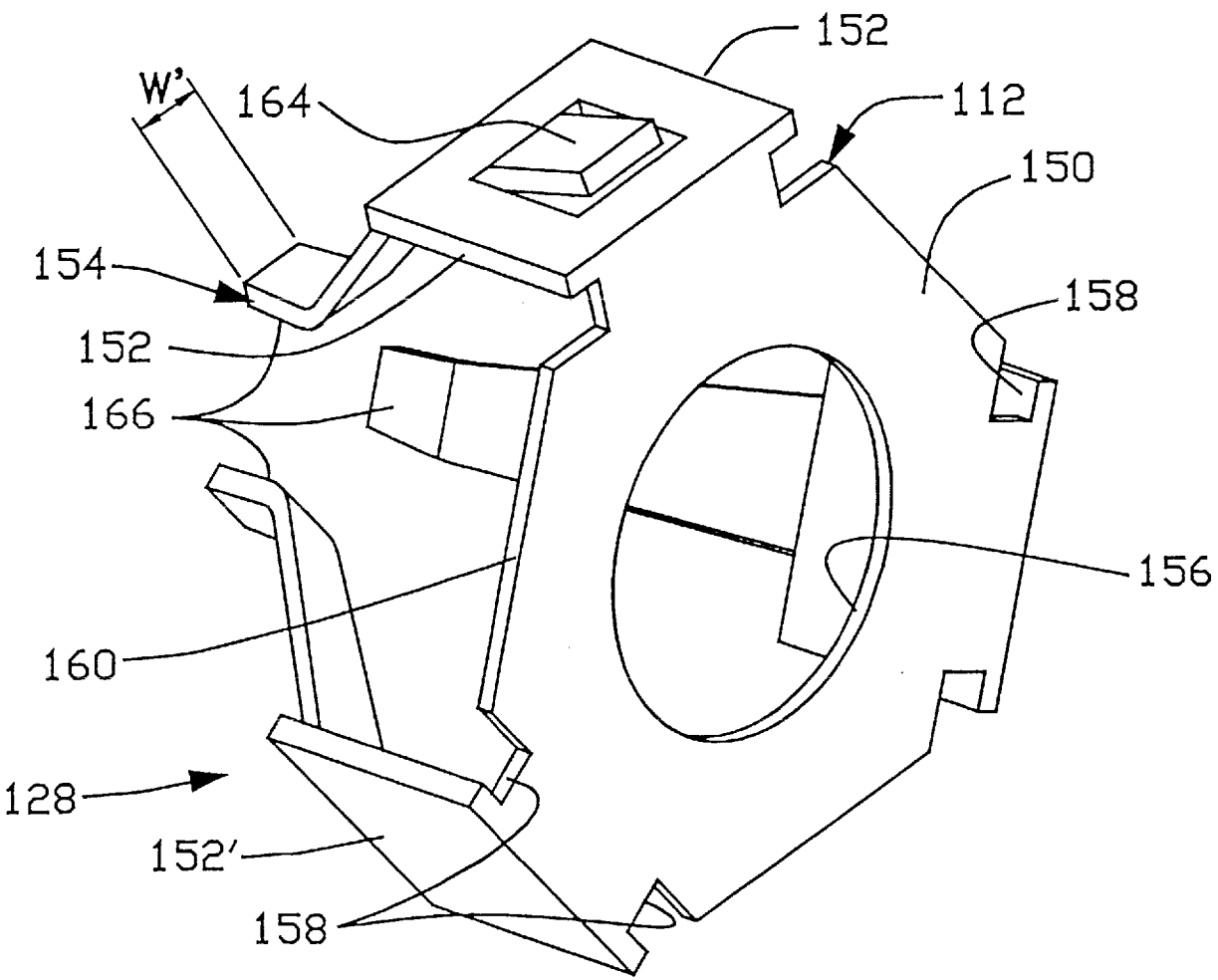
FIG. 8 is a perspective view of another contact element in accordance with the embodiment of FIG. 3.

With reference to FIGS. 5, 7 and 8, the jack connector 110 comprises an electrical contact element 126 and an electrical contact element 128. In accordance with another feature of the present invention, one or both of the electrical contact elements 126 and 128 comprise multiple contact wipers (discussed in more detail below) which increase the electrical contact surface area over a broad circumference of a plug connector thereby substantially reducing the possibility of electrical discontinuity between the jack connector and the plug connector when connected together.

In accordance with a feature of the present invention the electrical contact element 126 is configured as illustrated. The electrical contact element 126 may be composed of any suitably strong conductive material such as a metallic substance which is preferably spring tempered. Suitable materials include, for example, copper, steel plated with, e.g., nickel, copper or even gold for a low resistance, brass, beryllium copper, phosphor bronze or other material or alloy. The electrical contact element 126 comprises a hub 130 from which mounting plates 132 and contact wipers 134 extend. The hub 130 also includes a central aperture 136 and each mounting plate 132 is connected to the hub 130 by a connector arm 138. One or more of the connector arms 138 may include an aperture 140 whereto an electrical line (not shown) of, e.g., a musical instrument may be connected. It will also be understood that one or more of the mounting plates 132 may include an angled brace 142. When the electrical contact element 126 is mounted within the housing 112, the mounting plates fit within mounting slots 117 and the angled braces 142 slip into windows 120 to thereby lock the electrical contact element 126 in place.

The contact wipers 134 extend from the hub 130 and may have a generally constant width W and may be generally flat in cross section. The contact wipers 134 each include bent outer ends and a bent inner portion 146. The bent outer end 144 includes a curved portion 148 that is preferably dimensioned to fit within and generally match the curvature of the groove 38 of the plug connector 10 (FIG. 1). The contact wipers 134 may function to engage, e.g., shoulders 42 and 44 (FIG. 1) to thereby assist in reducing movement of the plug connector 10 within the jack connector 110.

In accordance with a further feature of the present invention an electrical contact element 128 is provided. The electrical contact element 128 may be composed of the same material as the electrical contact element 126 and comprises a hub 150, mounting plates 152 and wiper contacts 154. The hub 150 includes an aperture 156 where through a plug connector such as plug connector 10 (FIG. 1) may pass. Referring now also to FIG. 9, the hub 150 also comprises notches 158 that are shaped to receive the stepped portions 116 of the housing 112. The mounting plate 152 is dimensioned to fit within a mounting slot 117 of the housing 112.

A wire contact 160 extends from the hub 150 and includes an aperture 162 for receiving a ground wire from, e.g. a musical instrument (not shown) and the wire contact 160 is dimensioned to extend through the slot 118 of the housing 112. At least one of the mounting plates 152 comprises an angled brace 164 which, similar to angled brace 142, snaps into place adjacent the edge of the window 120 of the housing 112. Wiper contacts 154 are each connected to a mounting plate 152 and have a width W' which tapers from the fixed end (not numbered) to the free end thereof (not numbered). The wiper contacts 154 comprise bent portions 166 for contacting, e.g., the plug connector 10 (FIG. 1).

In accordance with a further feature of the present invention, the jack connector 110 may be manufactured by molding the housing 112, after inserting collar 114 in a suitable mold, to form the features thereof as described above. Also, contacts 126, 128 with the structure discussed above may be formed, e.g., by stamping a thin sheet of a material as discussed above. Next, the electrical contact element 128 may be mounted within the central cavity 115 of the housing 112 whereby the wire contact 160 slides within slot 118 and the angled brace 164 snaps into window 120. The electrical contact element 126 may then be mounted to the central cavity 115 whereby the angled brace 142 snaps into another window 120.

Figure 6:
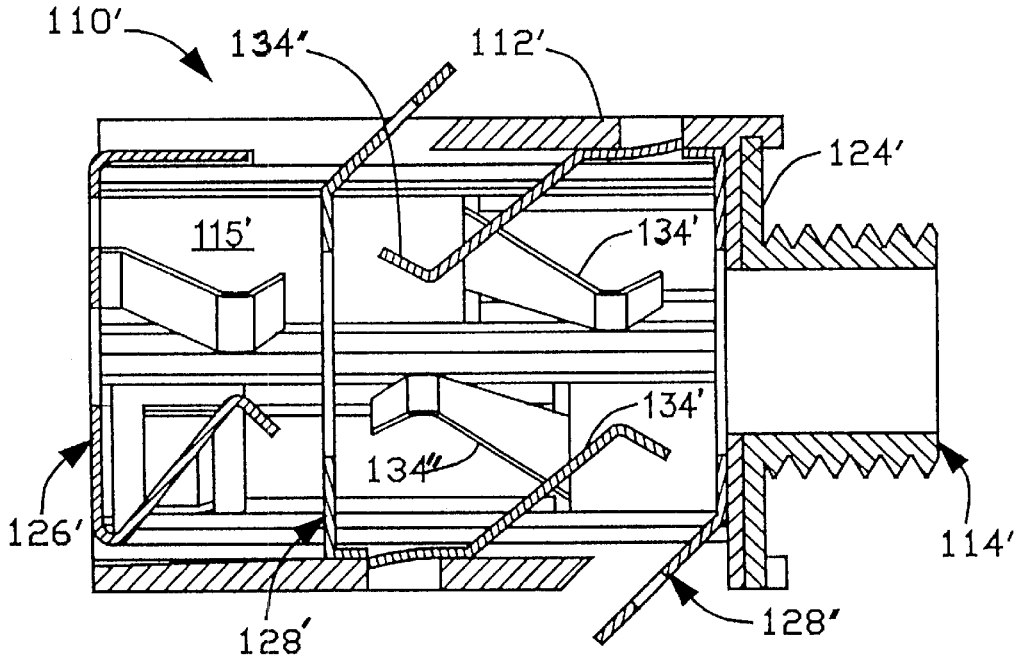
FIG. 6 is a sectional view similar to that of FIG. 4 illustrating a jack, connectable with the plug connector of FIG. 2, in accordance with another embodiment of the present invention.

Another embodiment of a jack connector in accordance with a further feature of the present invention is illustrated generally at 110' in FIG. 6. The jack connector 110' is preferably employed in combination with the plug connector 10' of FIG. 2, although, it will be understood that the jack connector may be employed with other compatible connectors and the same is true of the plug connector. In this embodiment, a third electrical contact element is provided for receiving a plug carrying, for example, two separate signals and a ground or shield. In accordance with this embodiment, an electrical contact 126', electrical contact element 128' and an additional electrical contact element 128" are mounted within the central cavity 115' of a housing 112'. It will be understood that a portion of housing 112' may be disposed between a flange 124' of the collar 114' and the contact element 128" in order to provide insulation therebetween.

The electrical contact element 128" is preferably the same as the electrical contact element 128 (FIG. 8) discussed above, although, when mounted to the housing 112' the electrical contact element 128" may be oriented within the central cavity 115' such that the contact wipers 134" extend in a direction which is opposite to that of contact wipers 134' of electrical contact element 128'. It will be appreciated that this arrangement allows for the formation of interchangeable parts between the embodiments of FIGS. 5 and 6 when desired.

Manufacture and assembly of the embodiment of FIG. 6 is similar to that of the embodiment of FIG. 5, although, an additional step of forming and assembling the electrical contact element 128" is required. Also, it may be advantageous to insert the electrical contact element 128" along with the collar 114' during molding of the housing 112'.

Figure 10:
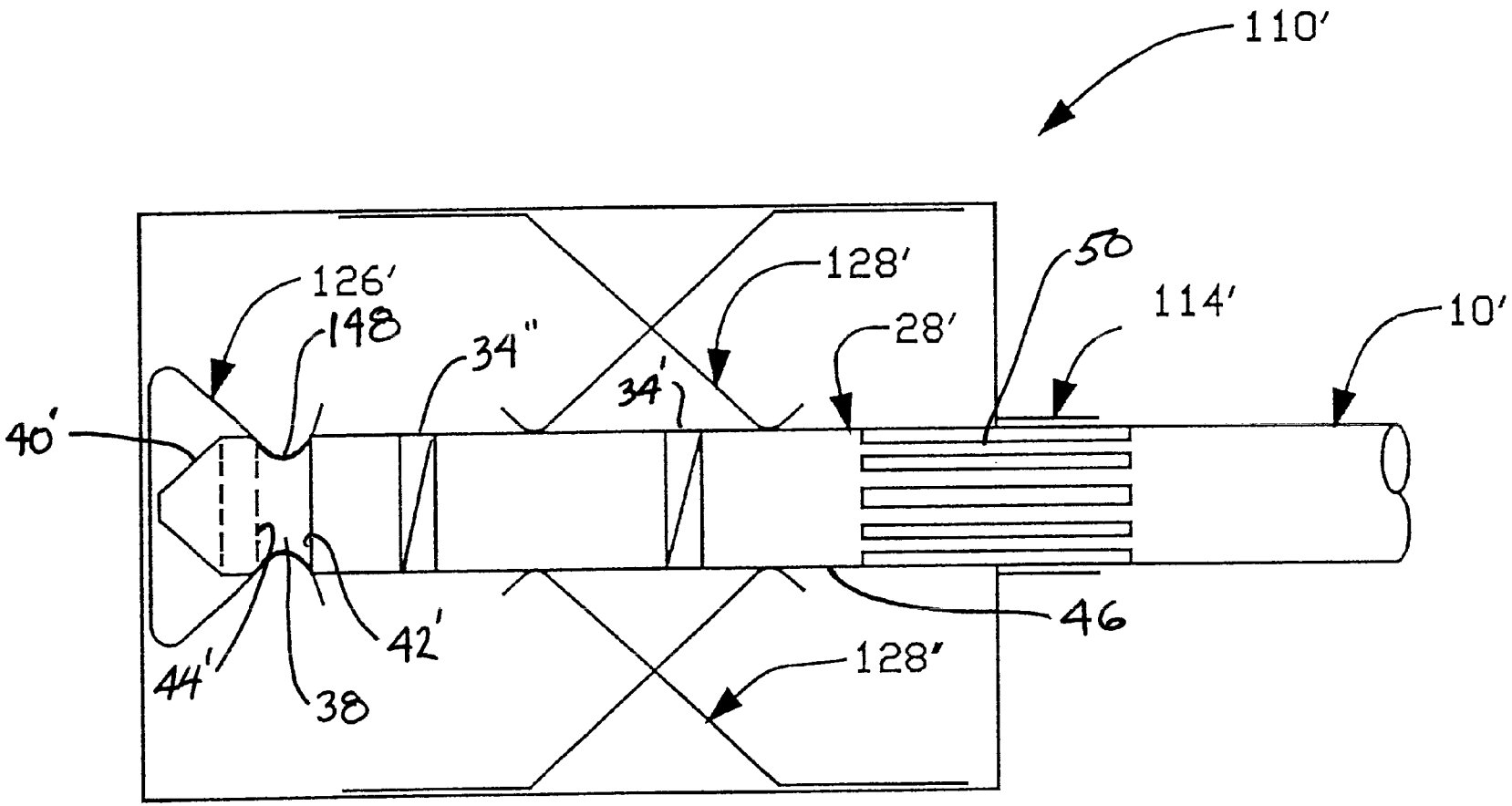
FIG. 10 is a schematic view of a portion of the plug connector of FIG. 2 disposed within the jack connector of FIG. 6.

As schematically illustrated in FIG. 10, the plug connector 10' may be inserted within the jack connector 110' and is supported in place there within by engaging the electrical contact elements 126', 128' and 128". The spring portion 28' of the plug connector 10' engages the collar 114' to further clamp the plug connector within the jack connector 110' and thereby reduce the amount of movement of the former relative to the latter. It will be understood that the schematic illustration of the plug connector 10' and jack connector 110' is for illustration purposes only and it will be appreciated that the plug connector 10 and jack connector 110 may be connected together in a similar manner.

Thus, when viewed in the context of FIGS. 1, 2, 6, and 10, it can be appreciated that the invention in one aspect is directed to a plug connector 110' on a cable 20 having a ground conductor and at least one signal conductor, comprising a handle 14 within which the cable 20 is received, and a tubular member 16' extending from the handle. The tubular member includes an electrically conductive external ground contact area 46' adjacent to the handle and electrically connected to the ground conductor within the handle. An insulating core 32' extends within the ground contact area 46' toward a distal end 40' of the connector. The distal end is in the form of an electrically conductive external tip that is electrically connected to the signal conductor of the cable 20, by a wire (not shown) extending within the core 32'. Preferably, another conductive signal portion 36' is situated between the signal tip 40' and the ground contact area 46', and insulated therefrom by means of, for example, insulating rings 34" and 34', respectively.

The tip 40' has a recess 38' formed therein for retentively engaging, as shown at 148, a signal contact 134 on the jack and the ground contact area 46' is electrically connected with the plurality of axially extending external spring elements 48, which are bowed outwardly 50, for retentively engaging a ground contact area 114' on the jack. It should be appreciated that, as described above, the cylindrical contact area 46 and circumferentially spaced strips 48 extending therefrom may be considered as a spring portion 28, which is in electrical contact with the grounded shielding of cable 20. The collar is preferably a conductive, metal material, as is conventional. Thus, as is evident from FIG. 10, ground wiper contacts 128', the contact area 46' of spring portion 28', the spring strips or elements 48', and the collar 114' and the conductive shielding of wire 20 are all at ground potential. Further as previously noted, the plug connector of the present invention can be used with a jack connector other than that shown in FIG. 10, and such other jack may not, for example, have a discrete ground wiper contact.

Similarly, the retentive interaction of the signal contact 126' of the jack, can vary somewhat from that shown in FIG. 10. For example, the recess 38' on the tip 40 is shown as defined as a con cave groove between two annular shoulders 42', 44', but other shapes of recess can be utilized whereby a relatively larger diameter leading portion of the tip (e.g., shoulder 44', initially bears against and then resiliently separates potions 148 of the signal contact element 126', such that upon further insertion to the insertion limit, the portion 148 is restored toward its natural position, thereby receiving a retentive engagement of the tip. Although the present invention is not directed to novelties in the tip configurations, the broad concept of retentively engaging the signal tip of the plug via corresponding structure in the jack, while simultaneously supporting the tubular potion of the plug with externally directed spring elements engaging corresponding structure in the jack, is central to the present invention, to achieve reduced relative movement when the plug connector and the jack connector are mated.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. A plug connector on a cable having a ground conductor and at least one signal conductor, for mating with a jack, comprising:

a handle within which the cable is received;

a tubular member extending from the handle to a distal end, said tubular member including, an electrically conductive, external ground contact area adjacent the handle and electrically connected to the ground conductor within the handle, an insulative core extending within the ground contact area toward the distal end of the tubular member, said distal end having an electrically conductive external tip, electrically connected to a said signal conductor by a wire extending within the core, and means for insulating the external ground contact area from the tip;

wherein the tip has a recess formed thereon for retentive engagement with a signal contact on said jack and a spring is supported externally in and electrically connected with the ground contact area, said spring including a plurality of axially extending, external spring elements for retentive engagement with a ground contact on said jack.

2. The plug connector of claim 1, wherein the tubular member further comprises an intermediate conductive portion disposed between and insulated from the contact area and the distal end, and the spring comprises at least one strip extending longitudinally along and being bowed radially outward of the central axis of the tubular member.

3. The plug connector of claim 2, wherein the contact area comprises a cylindrical portion having a side edge adjacent said intermediate conductive portion, and the spring comprises a plurality of circumferentially spaced strips extending toward the handle from the cylindrical portion in a direction that is parallel to the central axis of the contact area.

4. The plug connector of claim 2, wherein the core is disposed about two signal conductors.

5. The plug connector of claim 2, wherein said cable has a ground conductor and two signal conductors, with the ground conductor electrically connected to the ground contact area, one signal conductor electrically connected to said distal end, and the other signal conductor electrically connected to said intermediate conductive portion.

6. The plug connector of claim 5, wherein said cable is an audio cable.

7. The plug connector of claim 1, in combination with said jack connector, wherein the ground contact area of the plug includes a cylindrical portion and the jack has a ground contact on the plug cylindrical portion and wherein the jack connector has a grounded conductive collar and the spring elements of the plug are in interference engagement with said collar.

* * * * *

Disclaimer 6,494,746—James D'Addario, Old Westbury, NY. ELECTRONIC SIGNAL PLUG CONNECTOR. Patent dated Dec. 17, 2002. Disclaimer filed Nov. 26, 2003, by the assignee J.D. Addario & Company, Inc.

The term of this patent, subsequent to the term of patent number, 6,533,617 has been disclaimed.

*(Official Gazette, March 16, 2004)*